US011597223B2

(12) United States Patent
Aoki

(10) Patent No.: US 11,597,223 B2
(45) Date of Patent: Mar. 7, 2023

(54) LIQUID DISCHARGE APPARATUS

(71) Applicant: Yuuta Aoki, Kanagawa (JP)

(72) Inventor: Yuuta Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/534,897

(22) Filed: Nov. 24, 2021

(65) Prior Publication Data

US 2022/0169056 A1 Jun. 2, 2022

(30) Foreign Application Priority Data

Nov. 27, 2020 (JP) ..... JP2020-197286

(51) Int. Cl.
*B41J 29/17* (2006.01)

(52) U.S. Cl.
CPC ..... *B41J 29/17* (2013.01)

(58) Field of Classification Search
CPC ..... B41J 29/17; B41J 11/0015; B41J 3/4078; B41J 2/16517
See application file for complete search history.

(56) References Cited

U.S. PATENT DOCUMENTS

2015/0124034 A1* 5/2015 Shinoda ..... B41J 3/4078 347/104
2017/0225470 A1* 8/2017 Goto ..... B41J 2/165

FOREIGN PATENT DOCUMENTS

| | | | | |
|---|---|---|---|---|
| JP | H04176652 | A | | 6/1992 |
| JP | 2009/000979 | A | | 1/2009 |
| JP | 2011183746 | A | * | 9/2011 |
| JP | 2015/218419 | A | | 12/2015 |
| JP | 2015218419 | A | * | 12/2015 |
| JP | 2017/217803 | A | | 12/2017 |
| JP | 2020199634 | A | * | 12/2020 |
| WO | WO-2006/121022 | A1 | | 11/2006 |

OTHER PUBLICATIONS

Hase, MachineTranslationofJP-2020199634-A, 2020 (Year: 2020).*
Fujii, MachineTranslationofJP-2015218419-A, 2015 (Year: 2015).*
Oki, MachineTranslationofJP-2011183746-A, 2011 (Year: 2011).*

* cited by examiner

*Primary Examiner* — Scott A Richmond
(74) *Attorney, Agent, or Firm* — Harness, Dickey & Pierce, P.L.C.

(57) ABSTRACT

A liquid discharge apparatus includes a head, a holder, a remover, a charger, a static eliminator, and a cleaner. The head discharges a liquid onto a medium to perform printing on the medium. The holder holds the head. The remover is disposed on the holder to remove a foreign substance on the medium. The charger charges the remover before the printing. The static eliminator eliminates static electricity from the remover after the printing. The cleaner cleans the remover after the static electricity has been eliminated therefrom.

12 Claims, 15 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-197286, filed on Nov. 27, 2020, in the Japan Patent Office, the entire disclosure of which is hereby incorporated by reference herein.

BACKGROUND

Technical Field

Aspects of the present disclosure relate to a liquid discharge apparatus.

Description of the Related Art

In a liquid discharge apparatus, there is known a technique for removing foreign substances such as dust and fluff adhering to a medium.

SUMMARY

Embodiments of the present disclosure describe an improved liquid discharge apparatus that includes a head, a holder, a remover, a charger, a static eliminator, and a cleaner. The head discharges a liquid onto a medium to perform printing on the medium. The holder holds the head. The remover is disposed on the holder to remove a foreign substance on the medium. The charger charges the remover before the printing. The static eliminator eliminates static electricity from the remover after the printing. The cleaner cleans the remover after the static electricity has been eliminated therefrom.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
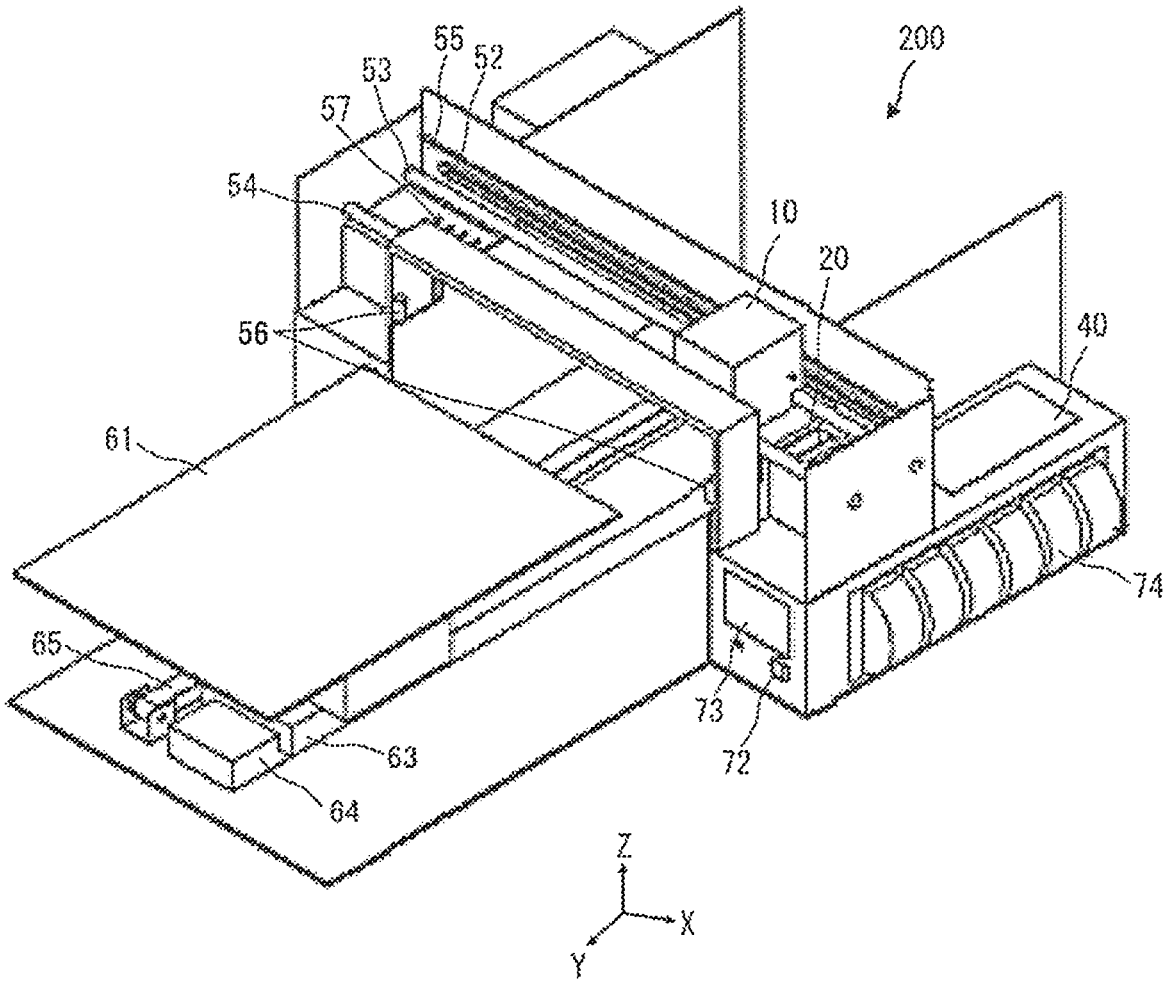
FIG. 1 is a perspective view illustrating an exterior of a printer as an example of a liquid discharge apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a," "an," and "the" are intended to include the plural forms as well, unless the context clearly indicates otherwise.

Embodiments of the present disclosure are described below with reference to the attached drawings. In the drawings for illustrating embodiments of the present disclosure, elements or components identical or similar in function or shape are given identical reference numerals as far as distinguishable, and redundant descriptions are omitted.

A liquid discharge apparatus according to an embodiment of the present disclosure includes a head (head 11) to discharge a liquid onto a medium to perform printing on the medium, a holder (carriage 10) to hold the head, a remover (remover 13) to remove a foreign substance on the medium, a charger (charger 21) to charge the remover, a static eliminator (static eliminator 25) to eliminate static electricity from the remover, and a cleaner (cleaner 23) to clean the remover. The remover is disposed adjacent to the head on the holder. The charger discharges the remover before the printing. The static eliminator eliminates static electricity from the remover after the printing. The cleaner cleans the remover after the static electricity has been eliminated therefrom. Note that names in parentheses "( )" correspond to a configuration illustrated in FIG. 4 as an example.

According to this configuration, in the liquid discharge apparatus, the remover is disposed on the carriage holding the head that discharges liquid from a nozzle. The charger included in a maintenance mechanism charges the remover before the printing. Accordingly, the remover can capture substances (e.g., dust and fluff) and prevent the captured substances from falling by electrostatic force during the printing. After the printing, the static eliminator eliminates static electricity from the remover, and then the cleaner removes the dust and fluff.

Figure 2:
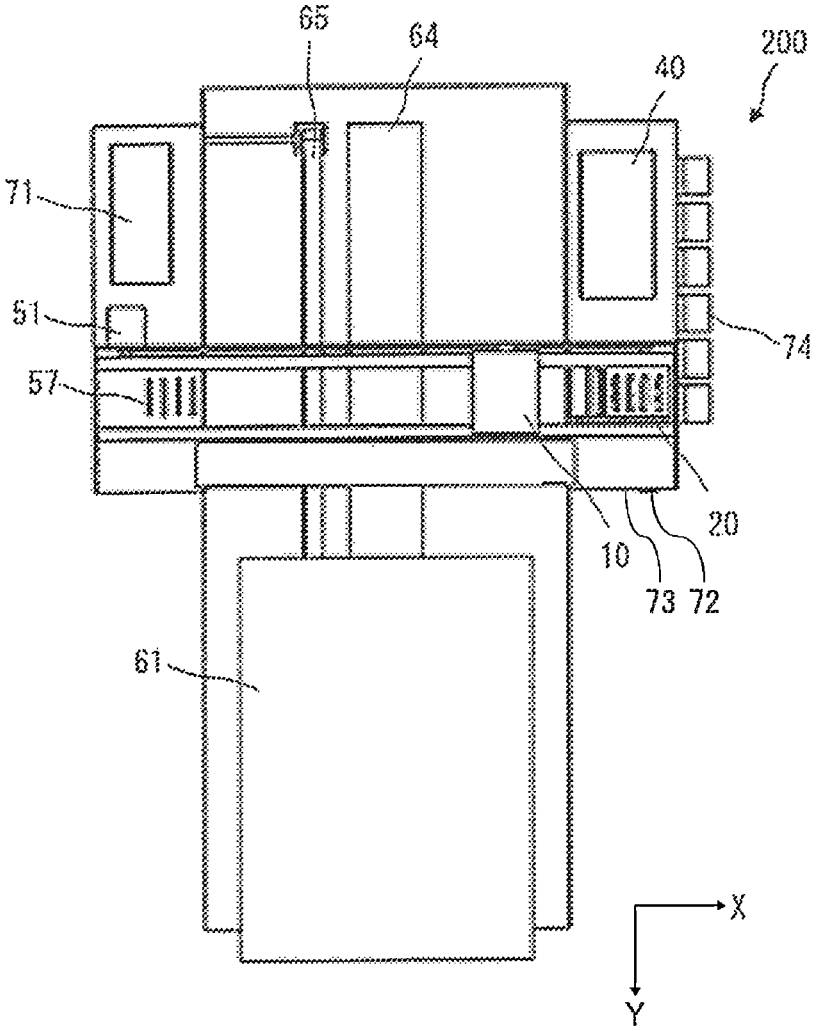
FIG. 2 is a top view of the printer in FIG. 1.
Figure 3:
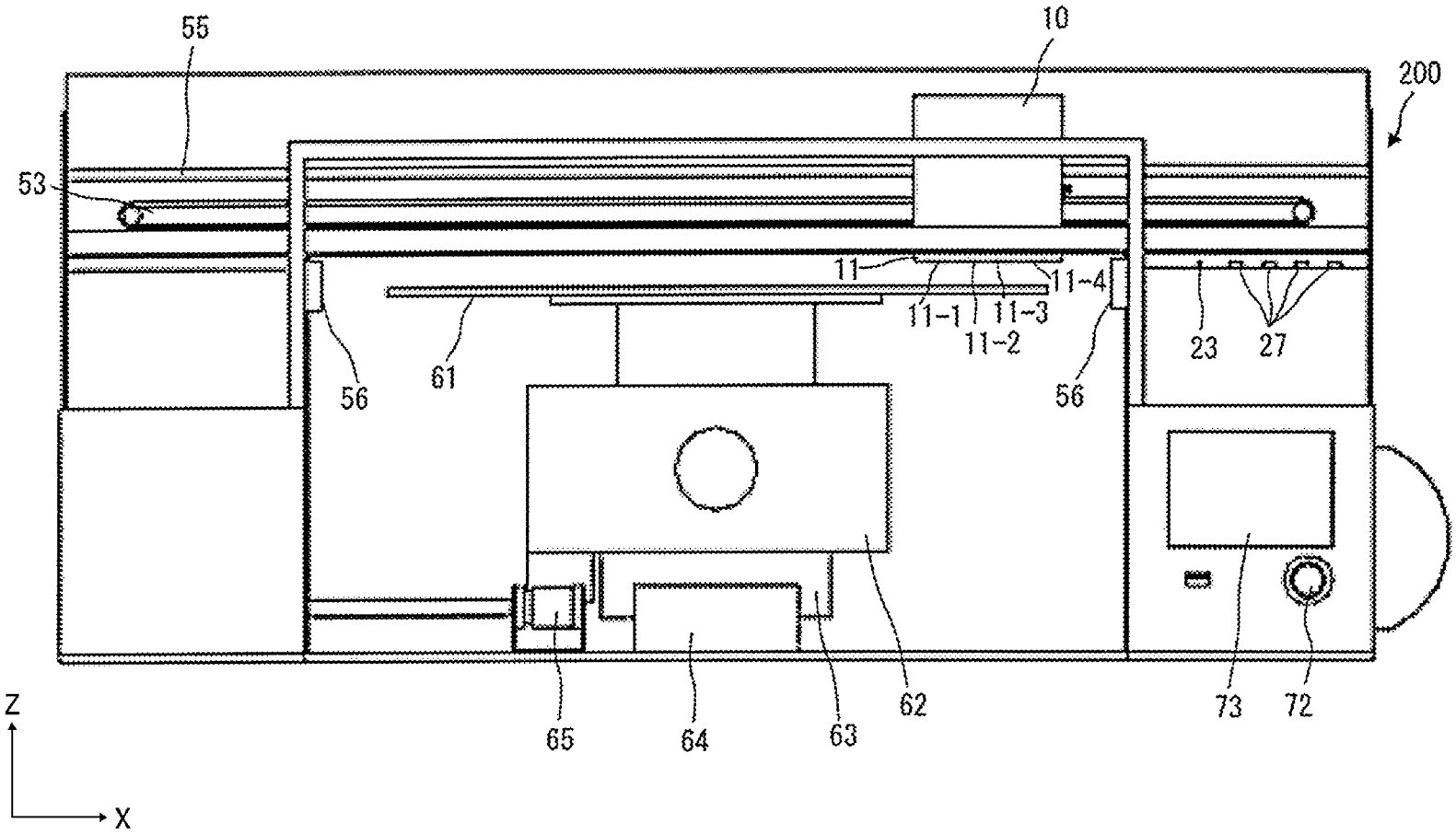
FIG. 3 is a front view of the printer in FIG. 1.

Hereinafter, a description is given of a configuration example of a printer serving as the liquid discharge apparatus according to embodiments of the present disclosure, and then each embodiment is described. FIGS. 1 to 3 illustrate an outline of the configuration example of a serial inkjet garment printer 200 (hereinafter, referred to as a "printer 200"), which is a so-called T-shirt printer. FIG. 1 is a perspective view illustrating an exterior of the printer 200 according to embodiments of the present disclosure. FIG. 2 is a top view of the printer 200. FIG. 3 is a front view of the printer 200.

The printer 200 includes a controller board 40 that processes and controls an operation (output) of a motor, a solenoid, and the like and an input signal of a sensor and the like. The printer 200 is controlled based on software installed in the controller board 40. Hereinafter, the controller board 40, and the software installed in the controller board 40 are referred to as a controller. The controller causes the printer 200 to print based on print data. The print data is transmitted from a personal computer (PC) or read from a universal serial bus (USB) memory or the controller board 40.

The printer 200 includes a carriage 10 mounting a head 11 that discharges ink. The carriage 10 moves in the transverse direction of a body of the printer 200 along a main guide rod 53 and a sub guide rod 54 as a main scanning motor 51 drives a timing belt 52. The printer 200 further includes an encoder sheet 55 on which slits are cyclically formed or printed and a sensor mounted on the carriage 10. While the sensor reads the encoder sheet 55 to detect a position of the carriage 10, the controller board 40 causes the carriage 10 to discharge ink droplets at discharge positions in synchronization with the reading of the sensor, thereby forming an image.

Four liquid discharge heads 11-1 to 11-4 are mounted on the carriage 10, and each of the liquid discharge heads 11-1 to 11-4 has two nozzle rows arranged in the sub-scanning direction. When the four liquid discharge heads 11-1 to 11-4 are not distinguished from each other, the liquid discharge heads 11-1 to 11-4 are collectively referred to as the "heads 11," and each of the liquid discharge heads 11-1 to 11-4 is referred to as the "head 11." A head tank that temporarily stores ink to be discharged is disposed immediately above the head 11 in the carriage 10. The head tank is coupled to an ink cartridge 74 via an ink supply tube and an ink supply pump. The ink supply pump is operated to supply ink from the ink cartridge 74 to the head tank.

During printing, the head 11 performs a dummy discharge at the position facing a dummy discharge receptacle 57 under the control of the controller board 40. A power supply unit 71 supplies power to the printer 200. The printer 200 includes a maintenance mechanism (maintenance unit) 20. The maintenance mechanism 20 includes, for example, a cap (moisturizing cap) 27 that caps the head 11, and a cleaner 23 that cleans the head 11 with a wiper. The maintenance mechanism 20 is described in detail in each embodiment.

A print medium (e.g., T-shirt) is set on a platen 61. The platen 61 is mounted on a platen elevator 62 that adjusts the position of the platen 61 along the Z-axis in the vertical direction. The platen elevator 62 is mounted on a sub-scanning slider 63. The sub-scanning slider 63 is movable along a sub-scanning guide rail 64 in the sub-scanning direction. The controller board 40 controls a sub-scanning timing belt 65 and a sub-scanning driver to move the sub-scanning slider 63.

When printing on a T-shirt as a recording medium, the operation is performed in the following procedure. First, a user presses a power button 72 to activate the printer 200, and then sets the T-shirt on the platen 61. Then, the user operates an operation unit 73 to completely pulls the sub-scanning slider 63 together with the platen 61 toward a rear portion of the printer 200 (in the negative Y-direction in FIG. 1). When die platen 61 is pulled, a height sensor 56 detects whether or not the T-shirt on the platen 61 collides with the head 11. If the T-shirt may collide with the head 11, the controller stops the platen 61 being pulled on the spot or causes the platen 61 to return to a position to set a T-shirt on a front portion of the printer 200. When the platen 61 is fully pulled to the rear portion of the printer 200 without any problems, the printer 200 becomes a print-data standby state.

As the user transmits print data from the PC to the printer 200 or selects print data stored in advance in the controller board 40 with the operation unit 73, the printer 200 starts printing. As the printer 200 starts printing, the sub-scanning slider 63 (i.e., the platen 61) moves to a printing start position. Thereafter, the carriage 10 described above discharges ink while moving to the right or left in FIGS. 2 and 3 (one scan) to form an image on the T-shirt. When the carriage 10 finishes moving (one scan), the sub-scanning slider 63 (i.e., the platen 61) moves an appropriate distance toward the front portion of the printer 200 (i.e., line feed) to move the T-shirt to the next printing position.

After the sub-scanning slider 63 finishes moving (line feed), the carriage 10 performs printing for another scan. The printer 200 repeats the scan of the carriage 10 and the movement of the sub-scanning slider 63 to form an image in the desired area. After the printer 200 finishes repeating, the platen 61 is ejected to the front portion of the printer 200 to complete printing. Each of the embodiments of the liquid discharge apparatus according to the present disclosure is described below.

Figure 4:
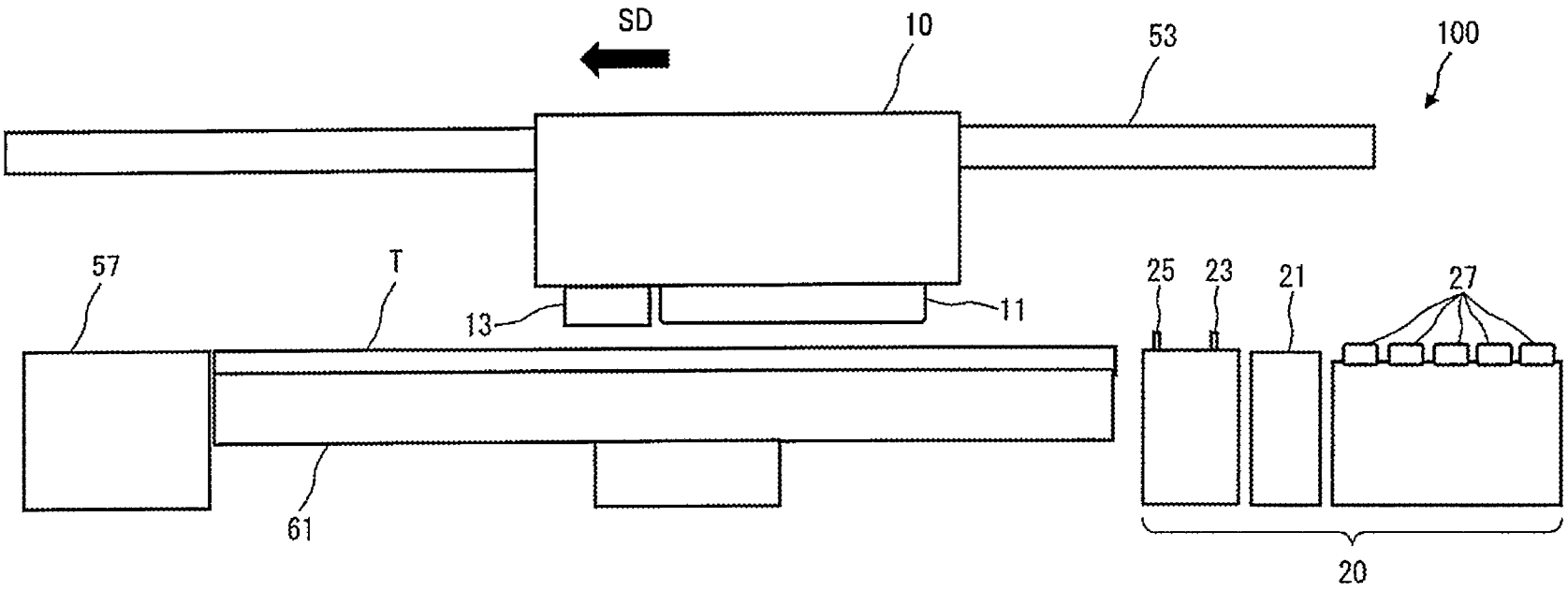
FIG. 4 is a schematic view of a liquid discharge apparatus according to a first embodiment of the present disclosure.

FIG. 4 is a schematic view of a liquid discharge apparatus 100 according to a first embodiment. The liquid discharge apparatus 100 according to the first embodiment includes at least the head 11, the carriage 10 as a holder, a remover 13, a charger 21, a static eliminator 25, or the cleaner 23. The head 11 discharges liquid onto a medium T to form an image. The head 11 includes a nozzle from which the liquid is discharged. The carriage 10 holds the head 11. In the present embodiment, the head 11 mounted on the carriage 10 includes five liquid discharge heads.

The remover 13 is disposed on the carriage 10 to remove foreign substances such as dust and fluff on the medium T. The remover 13 is disposed adjacent to the head 11 along the scanning direction of the carriage 10 (i.e., the direction of movement of the carriage 10). With this configuration, the head 11 can discharges liquid without foreign substances on the medium T after the remover 13 removes the foreign substances. The remover 13 includes, for example, a plate member. The remover 13 is disposed at the same height as a nozzle surface of the head 11 on which the nozzle is formed.

The charger 21 charges the remover 13. The cleaner 23 cleans the remover 13. The cleaner 23 includes, for example, a wiper. The wiper that cleans the head 11 can be used as the cleaner 23 to clean the remover 13.

The static eliminator 25 eliminates static electricity from the remover 13. Preferably, the static eliminator 25 also have a function of eliminating static electricity from the head 11.

The static eliminator 25 has, for example, a plate-shape and is disposed adjacent to the cleaner 23. The static eliminator 25 rises to the height of the remover 13 and comes into contact with the remover 13 to eliminate static electricity from the remover 13. The static eliminator 25 does not wipe the remover 13 unlike the cleaner 23 but contacts the remover 13. For example, after the cleaner 23 wipes the nozzle surface of the head 11, the static eliminator 25 rises and comes into contact with the remover 13 to eliminate static electricity from the remover 13.

The liquid discharge apparatus 100 includes the maintenance mechanism 20 including the charger 21, the cleaner 23, the static eliminator 25, and the cap 27 that caps the head 11. In the maintenance mechanism 20, the cap 27, the charger 21, the cleaner 23, and the static eliminator 25 are arranged in this order along the scanning direction of the carriage 10.

In the maintenance mechanism 20, the charger 21 charges the remover 13 before printing, the static eliminator 25 eliminates static electricity from the remover 13 after printing, and the cleaner 23 cleans the remover 13 after the static electricity has been eliminated therefrom. The controller board 40 (controller) controls the maintenance mechanism 20 before and after printing, for example.

Here, the terms "before printing" represent that the head 11 is on standby before image formation in which the head 11 discharges liquid to perform printing on the medium T, for example. The terms "after printing" represent that the head 11 has been cleaned after image formation. The liquid discharge apparatus 100 performs printing when the carriage 10 moves in the scanning direction indicated by arrow SD in FIG. 4 (from right to left in FIG. 4).

Figure 5:
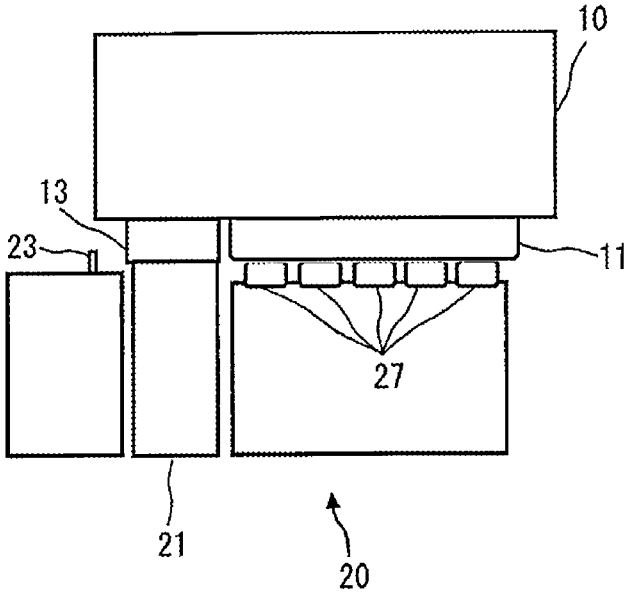
FIG. 5 is a schematic view illustrating a charger charging a remover in the liquid discharge apparatus in FIG. 4.

Next, a description is given of an operation example when the liquid discharge apparatus according to the first embodiment removes a foreign substance. During standby before image formation (for example, when the head 11 is held by the cap 27), the charger 21 charges the remover 13. FIG. 5 is a schematic view illustrating the charger 21 charging the remover 13. As illustrated in FIG. 5, the charger 21 is positioned adjacent to the cap 27, for example, and charges the remover 13 when the head 11 is on standby with the nozzle surface capped by the cap 27.

During image formation, the remover 13 captures dust and fluff on the medium T immediately before the head 11 discharges liquid from the nozzle. After image formation, the cleaner 23 cleans the head 11. Thereafter, the static eliminator 25 eliminates static electricity from the remover 13, and the cleaner 23 cleans the remover 13 from which the static electricity has been eliminated.

Figure 6:
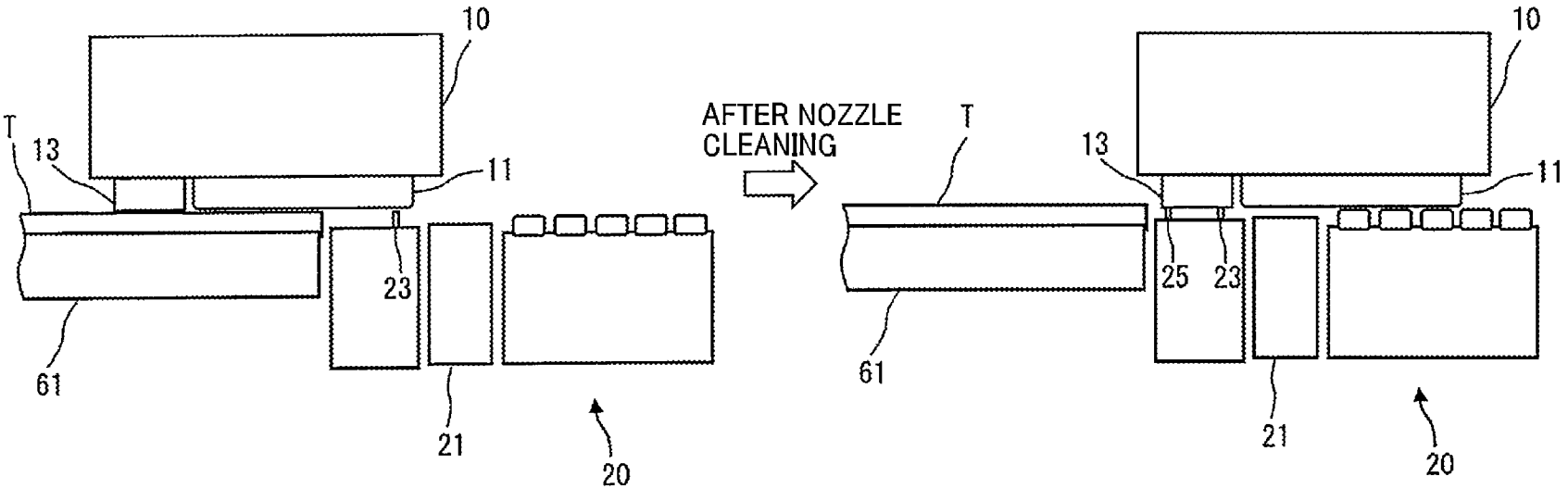
FIG. 6 is a schematic view illustrating a cleaner cleaning a nozzle and the remover after image formation in the liquid discharge apparatus in FIG. 4.

FIG. 6 is a schematic view illustrating the cleaner 23 cleaning the nozzle of the head 11 and the remover 13 after image formation. In FIG. 6, the cleaner 23 cleaning the nozzle of the head 11 is illustrated on the left side, and the cleaner 23 cleaning the remover 13 is illustrated on the right side. In FIG. 6, the static eliminator 25 rises and contacts the remover 13 when the cleaner 23 cleans the remover 13.

As described above, the charger 21 charges the remover 13 during standby before printing, and the remover 13 captures dust and fluff using electrostatic force during the printing (scanning of the carriage 10) to prevent the dust and fluff from separating until the end of the printing. After the printing, the static eliminator 25 contacts the remover 13 to eliminate static electricity from the remover 13 to eliminate the electrostatic force, and then the cleaner 23 cleans the remover 13.

Since the remover 13 is disposed adjacent to the head 11 on the carriage 10, the head 11 can discharge liquid to the medium T to form an image immediately after the remover 13 captures dust and fluff. As a result, dust and fluff are not generated on the medium T, thereby preventing the dust or fluff from adhering to the nozzle of the head 11 during image formation after the dust and fluff are captured. Thus, the liquid discharging performance of the head 11 does not deteriorate.

Figure 7:
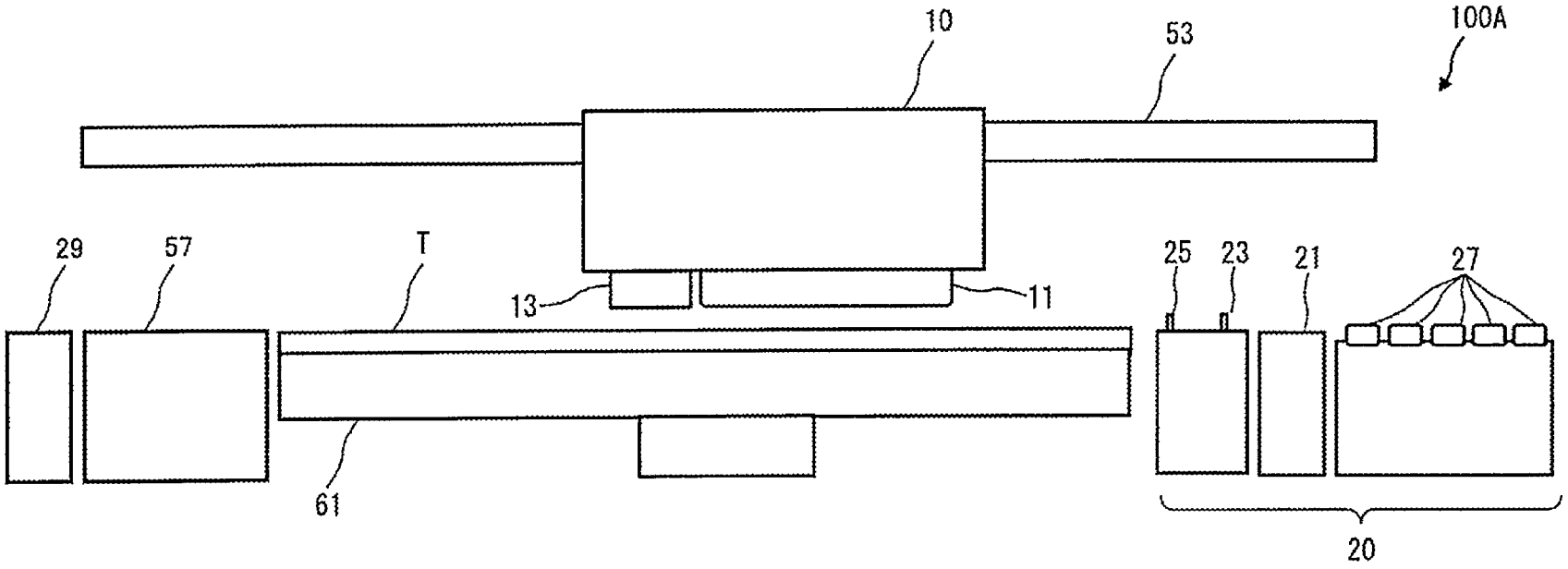
FIG. 7 is a schematic view illustrating a variation of the liquid discharge apparatus according to the first embodiment.

The liquid discharge apparatus 100 may further include another charger. FIG. 7 is a schematic view illustrating a liquid discharge apparatus 100A as a variation of the first embodiment. The liquid discharge apparatus 100A has a configuration in which a second charger 29 is added to the above-described liquid discharge apparatus 100. For example, the second charger 29 is disposed adjacent to the dummy discharge receptacle (also referred to as a "left dummy discharge receptacle") 57 disposed on the side of the platen 61 opposite to the charger 21 along the scanning direction of the carriage 10.

Since the second charger 29 is disposed adjacent to the left dummy discharge receptacle 57, the second charger 29 can charge the remover 13 to retain electrostatic force when the head 11 performs the dummy discharge during image formation. As a result, the remover 13 can capture dust and fluff during image formation without reducing the electrostatic force.

Figure 8B:
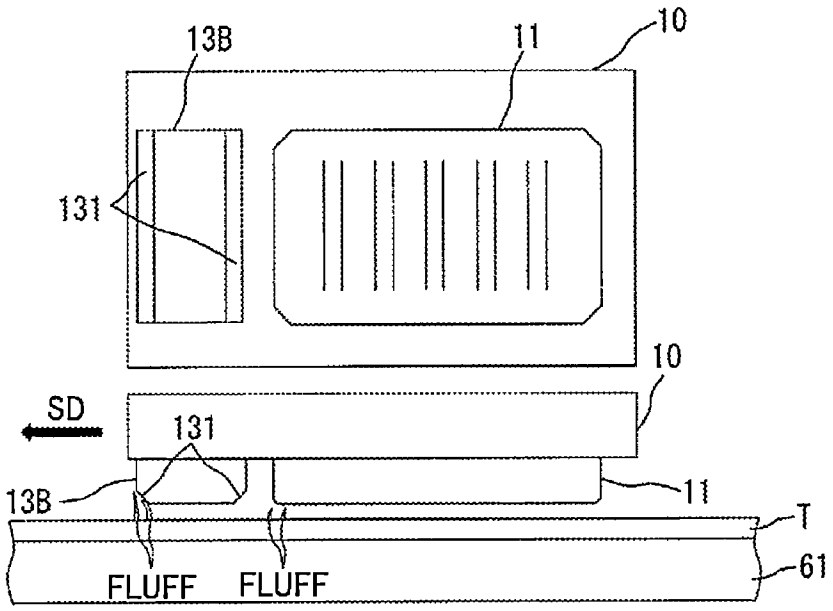
FIGS. 8A and 8B are schematic views illustrating an example of the remover according to a second embodiment of the present disclosure.
Figure 8A:
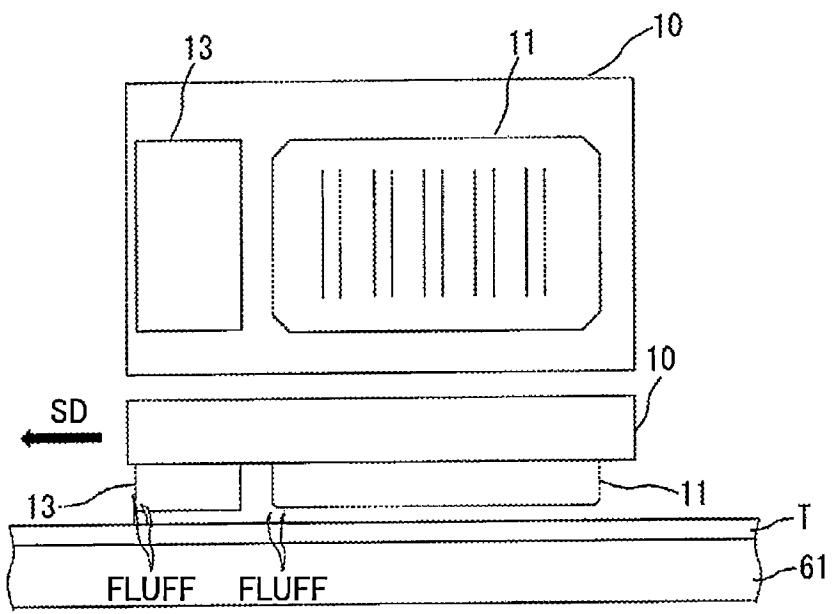

In a second embodiment, the remover 13 of the liquid discharge apparatus 100 according to the first embodiment is changed in shape. FIGS. 8A and 8B are schematic views illustrating an example of the remover according to the second embodiment. FIG. 8A illustrates of the remover 13 according to the first embodiment, and FIG. 8B illustrates of a remover 13B according to the second embodiment. In FIGS. 8A and 8B, upper portions of the drawings illustrate the head 11 and the remover 13 (13B) on the carriage 10 as viewed from below, and lower portions of the drawings illustrate a part of the configuration of the liquid discharge apparatus 100 illustrated in FIG. 4.

The remover 13B has a surface 131, which the remover 13 according to the first embodiment does not have, at an edge thereof in the scanning direction of the carriage 10. The edge of the remover 13B in the scanning direction of the carriage 10 is, for example, an intersection of a side face of the remover 13 intersecting (perpendicular to) the scanning direction of the carriage 10 and a surface of the remover 13 parallel to the medium T. For example, the remover 13B has the surface 131 having a rounded shape or a chamfered shape at the edge in the scanning direction of the carriage 10. That is, the edge of the remover 13B described above is processed by chamfering or rounding. As described above, the surface 131 at the edge of the remover 13B increases the contact area with dust and fluff, thereby improving the ability to remove foreign substances.

Figure 9C:
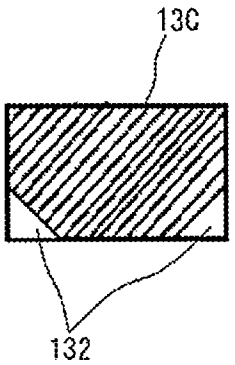
FIGS. 9A to 9C are schematic views illustrating another example of the remover according to the second embodiment.
Figure 9B:
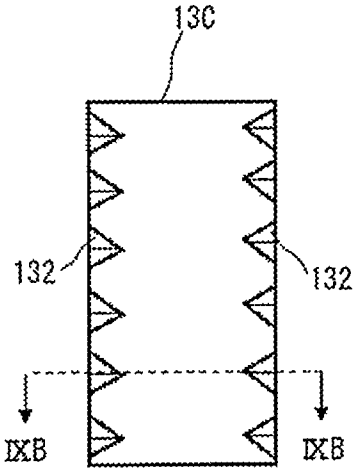
Figure 9A:
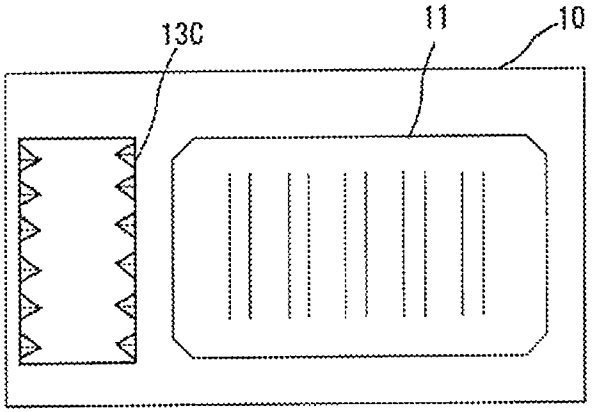

FIGS. 9A to 9C are schematic views illustrating a remover 13C as another example of the second embodiment. FIG. 9A illustrates the remover 13C, FIG. 9B is an enlarged view of the remover 13C, and FIG. 9C is a cross-sectional view of the remover 13C along line IXB-IXB in FIG. 9B. The remover 13C has the edge having notches 132 in the scanning direction of the carriage 10. For example, the remover 13 have the notches 132 in each of which a central portion is sandwiched by surfaces from both sides as illustrated in FIGS. 9A and 9B at the edge described above. The remover 13B illustrated in FIG. 8B may further have notches on the surface 131 having the chamfered shape or the rounded shape described above. Such a configuration further increases the contact area, thereby facilitating capturing the fluff.

In the above-described embodiment, the remover 13 may have a coarse side face in the scanning direction of the carriage 10. The same applies to the removers 13B and 13C of the above-described embodiments. For example, the removers 13, 13B, and 13C have a surface (e.g. the surface 131, the notches 132, and the like) at the edge (or a part of the edge) to increase the contact area with dust and fluff, or have a side face (and a surface of the edge) coarser than the surface parallel to the medium T, thereby facilitating capturing dust and fluff. These configurations of the removers 13, 13B, and 13C can improve the ability to capture dust and fluff due to the shape of the surface in addition to the electrostatic force.

In a third embodiment, the static eliminator 25 also eliminates static electricity from the head 11. The static eliminator 25 eliminates static electricity from the nozzle surface of the head 11 before printing. The static eliminator 25 is formed of, for example, a member (material) that can contact the head 11 in addition to the remover 13. As a result, the static eliminator 25 can eliminate static electricity accumulated in the head 11 by moving the carriage 10. Thus, even when the remover 13, 13B, or 13C according to the above-described embodiments does not capture dust or fluff, the head 11 from which the static electricity is eliminated can prevent the dust and fluff from adhering to the head 11. Further, the static eliminator 25 eliminates static electricity from the head 11, which is triboelectrically charged by air or contact with dust and fluff, before image formation. As a result, the dust or fluff are less likely to adhere the head 11.

Figure 10B:
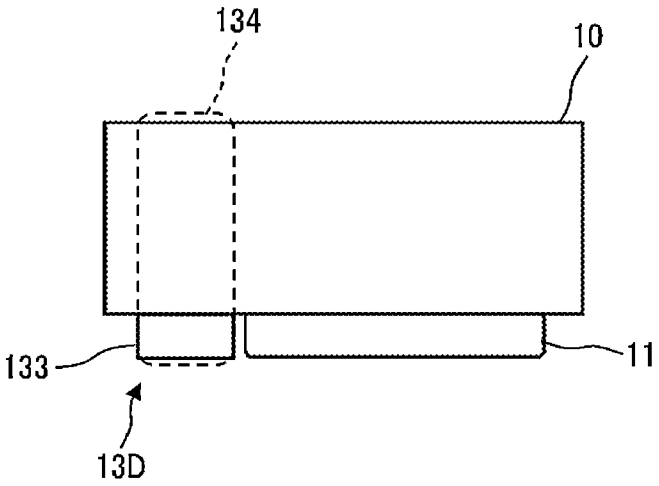
FIGS. 10A and 10B are schematic views illustrating an example of the remover according to a fourth embodiment of the present disclosure.
Figure 10A:
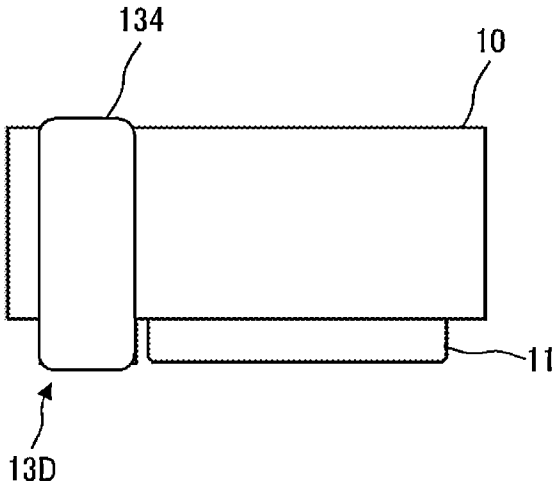

In a fourth embodiment, an example in which a sheet member is used as the remover. FIGS. 10A and 10B are schematic views illustrating a remover 13D as an example of the fourth embodiment. FIG. 10A illustrates the remover 13D including a sheet remover 134 attached to a remover base 133. FIG. 10B illustrates a position where the sheet remover 134 is attached, which is indicated by the broken line. The remover 13D according to the present embodiment includes the remover base 133 and the sheet remover 134. The sheet remover 134 surrounds the remover base 133, and the sheet remover 134 is movable to change a portion thereof that faces the medium T.

When the ability to capture dust or fluff deteriorates, the sheet remover 134 moves to change the portion thereof that faces the medium T so that a new portion (a portion that does not capture dust or fluff) of the sheet remover 134 faces the medium T. Such a configuration can maintain the ability to capture dust and fluff and extend life of the remover 13D. Further, the sheet remover 134 is made of a material that is easily charged (i.e., electrifiable), thereby improving the ability to capture dust and fluff.

Figure 11B:
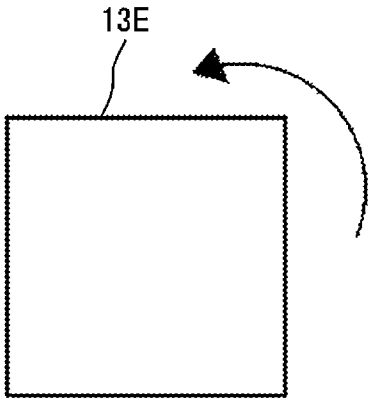
FIGS. 11A and 11B are schematic views illustrating an example of the remover according to a fifth embodiment of the present disclosure.
Figure 11A:
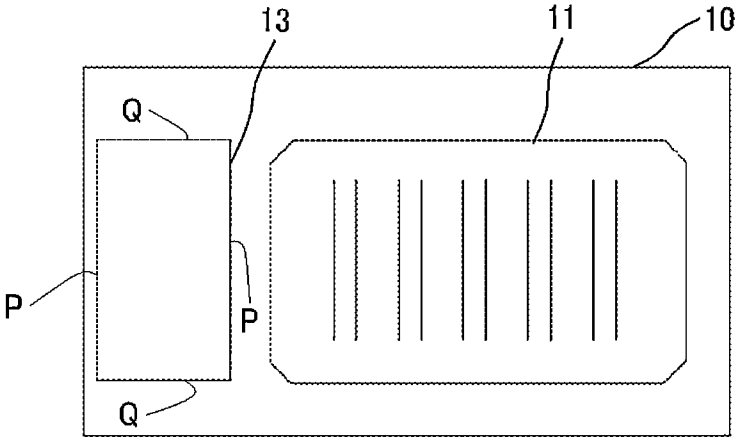

In a fifth embodiment, the shape of the remover is modified. FIGS. 11A and 11B are schematic views illustrating a remover 13E as an example of the fourth embodiment. FIG. 11A illustrates the remover 13 according to the first embodiment to describe modified point in the fifth embodiment, and FIG. 11B illustrate the remover 13E according to the fifth embodiment. The remover 13 has a portion that frequently captures dust and fluff and a portion that is relatively not used to capture dust and fluff. As illustrated in FIG. 11A, the side faces P of the remover 13 intersecting the scanning direction of the carriage 10 is frequently used, and the side faces Q of the remover 13 parallel to the scanning direction of the carriage 10 is rarely used.

Therefore, the remover 13E according to the present embodiment is mounted on the carriage 10 so as to have a shape rotatable by 90 degrees on a plane parallel to the medium T when the ability to capture dust and fluff deteriorates due to long-term use of the liquid discharge apparatus 100. The remover 13E have a substantially square shape, for example. The substantially square shape is not limited to the strict square, and the lengths of the four side faces of the rectangle shape of the remover 13E may be different as long as the remover 13E can be installed so as to be rotatable by 90 degrees. The remover 13E is not limited to a substantially square shape, and a remover having a polygonal shape may be used. Further, the substantially square or polygonal shape may have curved corners. Thus, the remover 13E moves a portion relatively not used to capture foreign substances to the position where to frequently capture foreign substances, thereby maintaining the ability to capture dust or fluff and extending the life of the remover 13E.

Figure 12B:
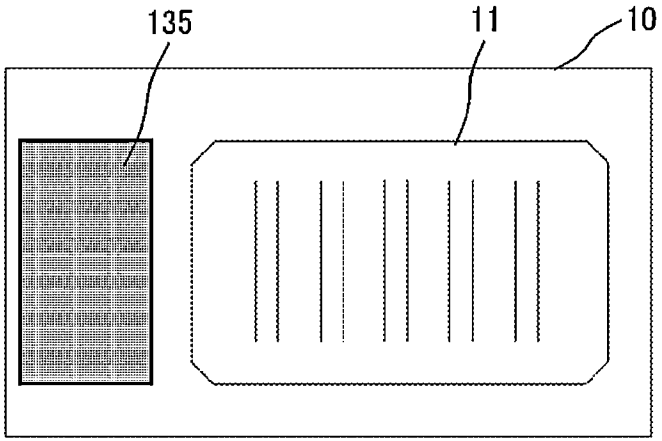
FIGS. 12A and 12B are schematic views illustrating another example of the remover according to the fifth embodiment.
Figure 12A:
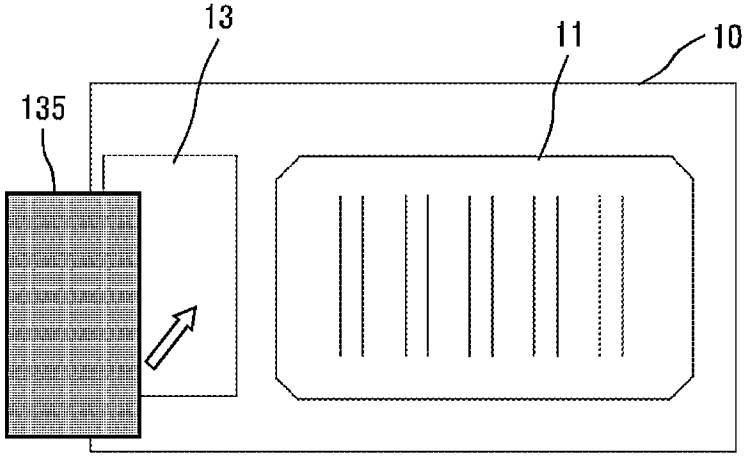

FIGS. 12A and 12B are schematic views illustrating the remover 13 as another example of the fifth embodiment. FIG. 12A illustrates the remover 13 before a protective seal 135 is attached, and FIG. 12B illustrates the remover 13 to which the protective seal 135 is attached. The replaceable protective seal 135 is attachable to the surface of the remover 13 that faces the medium T. Such a configuration can maintain the ability to capture dust and fluff and extend the life of the remover 13.

The protective seal 135, which is included in a maintenance kit, for example, is attached to the surface of the remover 13 that captures dust and fluff, and the protective seal 135 is replaced with new one when the ability to capture dust and fluff deteriorates, thereby extending the life of the main body of the remover 13. Further, the protective seal 135 is made of a material that is easily charged (i.e., electrifiable). Such a configuration can extend the life of the remover 13 and also improve the ability to capture dust and fluff.

Figure 13:
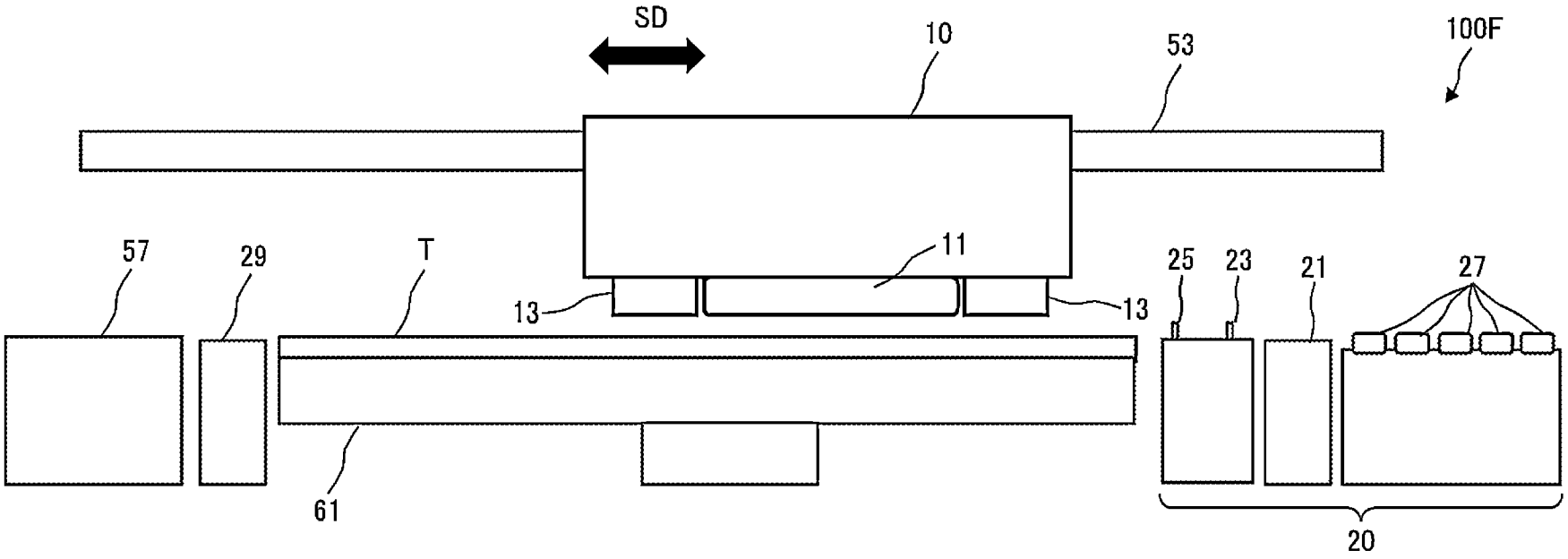
FIG. 13 is a schematic view illustrating an example of the liquid discharge apparatus according to a sixth embodiment.

In a sixth embodiment, the removers are disposed on both sides of the head. In the above-described liquid discharge apparatus 100 illustrated in FIG. 4 or the liquid discharge apparatus 100A illustrated in FIG. 7, dust or fluff on the nozzle surface may not be sufficiently removed when bidirectional printing is performed. Therefore, the removers 13 are preferably disposed on both sides of the head 11. FIG. 13 is a schematic view illustrating an example of a liquid discharge apparatus 100F according to the sixth embodiment. The liquid discharge apparatus 100F has a configuration in which another remover 13 is added on the right side of the head 11 in FIG. 13 and the arrangement of the second charger 29 and the dummy discharge receptacle 57 is reversed as compared with the liquid discharge apparatus 100A illustrated in FIG. 7.

In the liquid discharge apparatus 100F, as the carriage 10 moves from right to left in FIG. 13, the charger 21 charges the remover 13 on the left side of the head 11 and the remover 13 on the right side in this order. Alternatively, as the carriage 10 moves from left to right in FIG. 13, the charger 21 charges the remover 13 facing the charger 21. Further, as the carriage 10 moves from right to left in FIG. 13, the second charger 29 faces and charges the remover 13 on the left side of the head 11. At that time, the head 11 does not face the dummy discharge receptacle 57. As the head 11 faces the dummy discharge receptacle 57, the second charger 29 rises and charges the remover 13 on the right side of the head 11.

The configurations of the liquid discharge apparatuses according to the above-described embodiments can be combined as appropriate.

Figure 14:
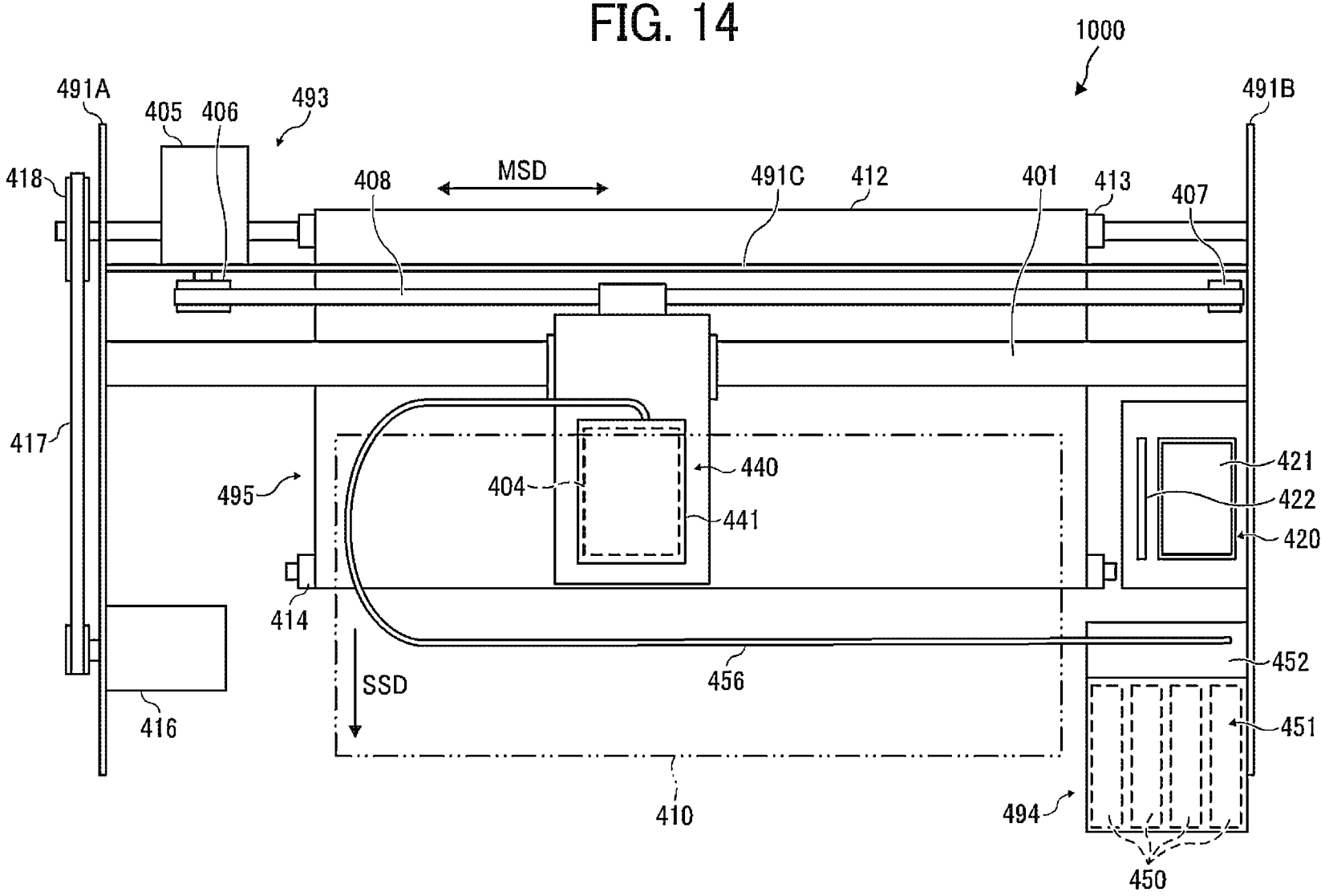
FIG. 14 is a schematic plan view of a part of the liquid discharge apparatus according to embodiments of the present disclosure.
Figure 15:
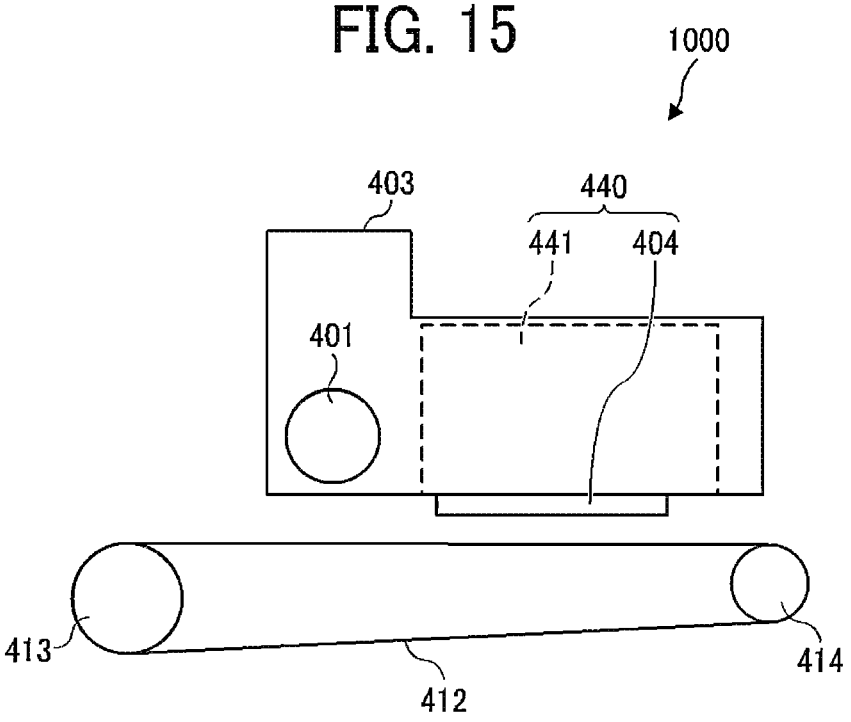
FIG. 15 is a schematic side view of a part of the liquid discharge apparatus in FIG. 14.

Next, an example of a liquid discharge apparatus, in which foreign substances on the medium T are removed as described in the above embodiments, is described with reference to FIGS. 14 and 15. FIG. 14 is a plan view of a part of a liquid discharge apparatus 1000. FIG. 15 is a side view of the part of the liquid discharge apparatus 1000 in FIG. 14.

The liquid discharge apparatus 1000 is a serial-type apparatus in which a main-scanning moving mechanism 493 reciprocates a carriage 403 in the main scanning directions indicated by arrow MSD in FIG. 14. The main-scanning moving mechanism 493 includes a guide 401, a main-scanning motor 405, and a timing belt 408. The guide 401 is bridged between left and right side plates 491A and 491B to moveably hold the carriage 403. The main-scanning motor 405 reciprocates the carriage 403 in the main scanning direction via the timing belt 408 looped around a drive pulley 406 and a driven pulley 407.

The carriage 403 is mounted with a liquid discharge unit 440 according to an embodiment of the present disclosure including a liquid discharge head 404 and a head tank 441 as a single integrated unit. The liquid discharge head 404 of the liquid discharge unit 440 discharges color liquids of, for example, yellow (Y), cyan (C), magenta (M), and black (K). The liquid discharge head 404 is mounted on the carriage 403 such that a nozzle row including a plurality of nozzles is arranged in the sub-scanning direction perpendicular to the main scanning direction. The liquid discharge head 404 discharges the color liquid downward.

A supply mechanism 494 disposed outside the liquid discharge head 404 supplies liquid stored in liquid cartridges 450 to the head tank 441 of the liquid discharge head 404. The supply mechanism 494 includes a cartridge holder 451 which is a filling part to mount the liquid cartridges 450, a tube 456, a liquid feed unit 452 including a liquid feed pump, and the like. The liquid cartridge 450 is detachably mounted on the cartridge holder 451. The liquid feed unit 452 feeds the liquid from the liquid cartridge 450 to the head tank 441 via the tube 456.

The liquid discharge apparatus 1000 further includes a conveyance mechanism 495 to convey a sheet 410. The conveyance mechanism 495 includes a conveyance belt 412 as a conveyor and a sub-scanning motor 416 to drive the conveyance belt 412. The conveyance belt 412 attracts the sheet 410 and conveys the sheet 410 to a position facing the liquid discharge head 404. The conveyance belt 412 is an endless belt stretched between a conveyance roller 413 and a tension roller 414. The sheet 410 can be attracted to the conveyance belt 412 by electrostatic attraction, air suction, or the like. The conveyance belt 412 circumferentially moves in the sub-scanning direction as the conveyance roller 413 is rotationally driven by the sub-scanning motor 416 via a timing belt 417 and a timing pulley 418.

On one side of the carriage 403 in the main scanning direction, a maintenance mechanism 420 that maintains and recovers the liquid discharge head 404 is disposed lateral to the conveyance belt 412. The maintenance mechanism 420 includes, for example, a cap 421 to cap the nozzle surface (i.e., the surface on which nozzles are formed) of the liquid discharge head 404 and a wiper 422 to wipe the nozzle surface.

The main-scanning moving mechanism 493, the supply mechanism 494, the maintenance mechanism 420, and the conveyance mechanism 495 are mounted onto a housing including the side plates 491A and 491B and a back plate 491C.

In the liquid discharge apparatus 1000 having the above-described configuration, the sheet 410 is fed and attracted onto the conveyance belt 412 and conveyed in the sub-scanning direction indicated by arrow SSD as the conveyance belt 412 circumferentially moves. The liquid discharge head 404 is driven in response to an image signal while moving the carriage 403 in the main scanning direction to discharge liquid onto the sheet 410 not in motion, thereby forming an image.

As described above, the liquid discharge apparatus 1000 includes the liquid discharge head 404 to which the above-described embodiments of the present disclosure are applied, thus allowing stable formation of high quality images.

In the above-described embodiments, the "liquid discharge apparatus" includes the liquid discharge head or the liquid discharge unit and drives the liquid discharge head to discharge liquid. The liquid discharge apparatus may be, for example, an apparatus capable of discharging liquid to a material onto which liquid can adhere or an apparatus to discharge liquid toward gas or into liquid.

The "liquid discharge apparatus" may include devices relating to feeding, conveyance, and ejection of the material onto which the liquid can adhere and also include a pro-treatment device and a post-processing device.

The "liquid discharge apparatus" may be, for example, an image forming apparatus to form an image on a sheet by discharging ink, or a three-dimensional apparatus to discharge a fabrication liquid to a powder layer in which powder material is formed in layers, so as to form a three-dimensional object.

The "liquid discharge apparatus" is not limited to an apparatus that discharges liquid to visualize meaningful images such as letters or figures. For example, the liquid discharge apparatus may be an apparatus that forms meaningless images such as meaningless patterns or an apparatus that fabricates three-dimensional images.

The above-described term "material onto which liquid can adhere" represents a material on which liquid is at least temporarily adhered, a material on which liquid is adhered and fixed, or a material into which liquid is adhered to permeate. Specific examples of the "material onto which liquid can adhere" include, but are not limited to, a recording medium such as a paper sheet, recording paper, a recording sheet of paper, a film, or cloth, an electronic component such as an electronic substrate or a piezoelectric element, and a medium such as layered powder, an organ model, or a testing cell. The "material onto which liquid can adhere" includes any materials to which liquid is adhered, unless particularly limited.

Examples of the "material onto which liquid can adhere" include any materials on which liquid can adhered even temporarily, such as paper, thread, fiber, fabric, leather, metal, plastic, glass, wood, ceramic, construction materials (e.g., wallpaper or floor material), and cloth textile.

Examples of the "liquid" include ink, treatment liquid, DNA sample, resist, pattern material, binder, fabrication liquid, and solution or liquid dispersion containing amino acid, protein, or calcium.

The term "liquid discharge apparatus" may be an apparatus to relatively move the liquid discharge head and the material onto which liquid can adhere. However, the liquid discharge apparatus is not limited to such an apparatus. Examples of the liquid discharge apparatus include a serial type apparatus which moves the liquid discharge head, and a line type apparatus which does not move the liquid discharge head.

Examples of the "liquid discharge apparatus" further include a treatment liquid coating apparatus to discharge a treatment liquid to a sheet surface to coat the sheet with the treatment liquid to reform the sheet surface and an injection granulation apparatus to discharge a composition liquid including a raw material dispersed in a solution from a nozzle to mold particles of the raw material.

The main-scanning moving mechanism may be a guide only. The supply mechanism may be a tube(s) only or a loading device only.

The liquid discharge head is not limited in the type of pressure generator used. For example, a piezoelectric actuator (which may use a laminated piezoelectric element), a thermal actuator using a thermoelectric conversion element such as a thermal resistor, and an electrostatic actuator including a diaphragm and a counter electrode can be used.

In the present specification, the terms "image formation," "recording," "printing," "image printing," and "fabricating" used herein may be used synonymously with each other.

As described above, according to the present disclosure, foreign substances such as dust and fluff on a medium can be removed, thereby improving the quality of printing.

It should be noted that the present disclosure is not limited to the above-described embodiments. In the scope of the present disclosure, it is possible to modify, add, and convert each element of the above-described embodiments into contents that person skilled in the art can easily conceive.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A liquid discharge apparatus comprising:

a head configured to discharge a liquid onto a medium to perform printing on the medium;

a holder holding the head;

a remover on the holder, the remover configured to remove a foreign substance on the medium;

a charger configured to charge the remover before the printing;

a static eliminator configured to eliminate static electricity from the remover after the printing; and a cleaner configured to clean the remover after the static electricity has been eliminated therefrom.

2. The liquid discharge apparatus according to claim 1, wherein the remover is disposed adjacent to the head along a scanning direction of the holder.

3. The liquid discharge apparatus according to claim 1, further comprising a cap configured to cap the head, wherein the cap, the charger, the cleaner, and the static eliminator are disposed in an order of the cap, the charger, the cleaner, and the static eliminator along a scanning direction of the holder.

4. The liquid discharge apparatus according to claim 1, wherein the static eliminator is further configured to eliminate static electricity from a nozzle surface of the head before the printing.

5. The liquid discharge apparatus according to claim 1, wherein the remover has an edge having a rounded shape or a chamfered shape in a scanning direction of the holder.

6. The liquid discharge apparatus according to claim 1, wherein the remover has an edge having notches in a scanning direction of the holder.

7. The liquid discharge apparatus according to claim 1, wherein the remover has a side face coarser than a surface parallel to the medium in a scanning direction of the holder.

8. The liquid discharge apparatus according to claim 1, wherein the remover includes a remover base and a sheet remover that surrounds the remover base, and wherein the sheet remover is movable to change a portion thereof that faces the medium.

9. The liquid discharge apparatus according to claim 1, wherein the remover has a shape rotatable by 90 degrees on a plane parallel to the medium.

10. The liquid discharge apparatus according to claim 1, further comprising a replaceable protective seal attached to a portion of the remover that faces the medium.

11. The liquid discharge apparatus according to claim 10, wherein the replaceable protective seal is electrifiable.

12. The liquid discharge apparatus according to claim 1, further comprising another charger configured to charge the remover.

* * * * *